US008061431B2

(12) United States Patent
Moore et al.

(10) Patent No.: US 8,061,431 B2
(45) Date of Patent: Nov. 22, 2011

(54) METHOD OF OPERATING A PRESSURE CYCLE OPERATED PERFORATING FIRING HEAD AND GENERATING ELECTRICITY IN A SUBTERRANEAN WELL

(75) Inventors: Randall S. Moore, Carrollton, TX (US); John H. Hales, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/978,811

(22) Filed: Dec. 27, 2010

(65) Prior Publication Data

US 2011/0088946 A1 Apr. 21, 2011

Related U.S. Application Data

(63) Continuation of application No. 12/372,873, filed on Feb. 18, 2009, now Pat. No. 8,006,779.

(51) Int. Cl.
*E21B 29/02* (2006.01)
*E21B 43/11* (2006.01)

(52) U.S. Cl. ..... 166/383; 166/66.5; 166/297; 166/63

(58) Field of Classification Search ..... 166/297, 166/383, 66.5, 374, 63; 175/4.56, 2; 89/1.15; 310/46, 88

See application file for complete search history.

(56) References Cited

U.S. PATENT DOCUMENTS 3,666,030 A * 5/1972 Bohn et al. ..... 175/4.56
3,800,705 A 4/1974 Tamplen
3,949,642 A 4/1976 Broxholm et al.
4,544,034 A 10/1985 George
4,606,409 A 8/1986 Peterson et al.
4,616,718 A 10/1986 Gambertoglio
4,629,001 A 12/1986 Miller et al.
4,648,470 A 3/1987 Gambertoglio
4,665,991 A 5/1987 Manke
4,678,044 A 7/1987 Luke et al.

(Continued)

FOREIGN PATENT DOCUMENTS

EP 0339774 A3 11/1989

OTHER PUBLICATIONS

Halliburton PES® Liquid Spring Module Drawing No. M15899, Mar. 1, 2008, 7 pages.

(Continued)

*Primary Examiner* — Kenneth L Thompson
*Assistant Examiner* — Cathleen Hutchins
(74) *Attorney, Agent, or Firm* — Marlin R. Smith

(57) ABSTRACT

Pressure cycle operated apparatus and methods. A method of actuating a firing head includes the steps of: reciprocably displacing an actuator piston of the firing head, the displacing step including the piston being alternately pressure balanced and unbalanced; and igniting a combustible material in response to the piston displacing step. A method of generating electricity includes: reciprocably displacing a piston, the displacing step including the piston being alternately pressure balanced and unbalanced; and generating electricity in response to the piston displacing step. A firing head includes an actuator piston separating at least two chambers; a check valve which permits one-way flow between the chambers; a flow restrictor which restricts flow between the chambers; a biasing device which biases the piston toward one of the chambers; and a firing pin releasing device which releases a firing pin in response to displacement of the piston.

12 Claims, 10 Drawing Sheets

U.S. PATENT DOCUMENTS

| | | | | |
|---|---|---|---|---|
| 4,690,227 | A | | 9/1987 | George et al. |
| 4,804,044 | A | | 2/1989 | Wesson et al. |
| 4,817,718 | A | | 4/1989 | Nelson et al. |
| 4,886,127 | A | | 12/1989 | Ricles et al. |
| 4,969,525 | A | | 11/1990 | George et al. |
| 5,103,906 | A | | 4/1992 | Schultz et al. |
| 5,161,616 | A | | 11/1992 | Colla |
| 5,167,282 | A | | 12/1992 | Schneider et al. |
| 5,209,303 | A | | 5/1993 | Barrington |
| 5,277,262 | A | | 1/1994 | Huber et al. |
| 5,839,508 | A | * | 11/1998 | Tubel et al. ..... 166/65.1 |
| 5,887,654 | A | | 3/1999 | Edwards et al. |
| 5,890,539 | A | | 4/1999 | Huber et al. |
| 5,992,289 | A | | 11/1999 | George et al. |
| 6,182,750 | B1 | | 2/2001 | Edwards et al. |
| 6,213,203 | B1 | | 4/2001 | Edwards et al. |
| 6,321,847 | B1 | | 11/2001 | Brown |
| 6,354,374 | B1 | | 3/2002 | Edwards et al. |
| 6,378,612 | B1 | | 4/2002 | Churchill |
| 6,554,074 | B2 | * | 4/2003 | Longbottom ..... 166/372 |
| 7,216,713 | B2 | | 5/2007 | Read, Jr. |
| 7,331,392 | B2 | | 2/2008 | Bosley et al. |
| 7,438,130 | B2 | | 10/2008 | Read, Jr. |
| 2004/0118562 | A1 | | 6/2004 | George |
| 2005/0284427 | A1 | | 12/2005 | Barth |
| 2008/0216640 | A1 | | 9/2008 | Brand |

OTHER PUBLICATIONS

Halliburton LSO Liquid Spring Device Drawing No. M15948, Oct. 7, 2008, 7 pages.

Halliburton PES® FS Fluid Loss Control Device Product Brochure, undated, 2 pages.

International Search Report with Written Opinion issued Sep. 30, 2010, for International Patent Application No. PCT/US10/024230, 9 pages.

* cited by examiner

METHOD OF OPERATING A PRESSURE CYCLE OPERATED PERFORATING FIRING HEAD AND GENERATING ELECTRICITY IN A SUBTERRANEAN WELL

CROSS-REFERENCE TO RELATED APPLICATION

The present application is a continuation of U.S. application Ser. No. 12/372,873 filed on Feb. 18, 2009. The entire disclosure of this prior application is incorporated herein by this reference.

BACKGROUND

This disclosure relates generally to equipment utilized and operations performed in conjunction with a subterranean well and, in an example described below, more particularly provides a pressure cycle operated perforating firing head.

It is very important that a firing head used, for example, to initiate explosives in a perforating gun is reliable and safe in operation. Many firing head designs have been proposed in the past, some of which operate in response to pressure applied to the firing head from a remote location. Unfortunately, these past designs have suffered from one or more significant drawbacks.

For example, most pressure operated firing heads rely on shear pins to select a pressure which, when applied to the firing head, shears the pins and initiates a detonation sequence, with or without a built-in delay. One disadvantage of these firing heads is that a large number of shear pins must be installed in order to select a correspondingly high actuation pressure, but each shear pin has an inherent shear value inaccuracy (e.g., due to variations in size, material composition, heat treatment, etc.), and these inaccuracies accumulate, with the result that high actuation pressures also have high inaccuracies.

Another disadvantage of these firing heads is that they typically include a chamber which is pressurized such that, either at the surface or downhole, a very large pressure differential exists between the chamber and the surrounding environment. For example, an atmospheric (or other relatively low pressure) chamber must be surrounded with a thick wall in order to withstand downhole pressures. On the other hand, a chamber which is pressurized (for example, with nitrogen) to a thousand or more psi (≧7000 kPa) at the surface not only requires a substantial wall surrounding the chamber, but also presents hazards to the personnel who must pressurize the chamber at the surface, handle and install the firing head after pressurization, etc.

Therefore, it may be seen that improvements are needed in the art of pressure operated firing heads. These improvements may also be useful in other operations, as well, such as in generating electricity downhole, etc.

SUMMARY

In the disclosure below, apparatus and associated methods are provided which solve at least one problem in the art. One example is described below in which a firing head or electrical generator does not require very large pressure differentials, either at the surface or downhole, in order to operate. Another example is described below in which the firing head can be effectively disarmed, so that it can be safely retrieved from a wellbore.

In one aspect, a method of actuating a firing head in a subterranean well is provided. The method includes the steps of: reciprocably displacing an actuator piston of the firing head in the well, and igniting a combustible material in response to the piston displacing step. The displacing step includes the piston being alternately pressure balanced and unbalanced.

In another aspect, a method of generating electricity in a subterranean well includes the steps of: reciprocably displacing a piston in the well, the displacing step including the piston being alternately pressure balanced and unbalanced; and generating electricity in response to the piston displacing step.

In yet another aspect, a firing head for detonating explosives in a subterranean well is provided which includes an actuator piston separating at least two chambers; a check valve which permits flow from one chamber to the other chamber, but prevents flow from the second chamber to the first chamber; a flow restrictor which restricts flow between the chambers; a biasing device which biases the piston toward the second chamber; and a firing pin releasing device which releases a firing pin in response to displacement of the piston.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
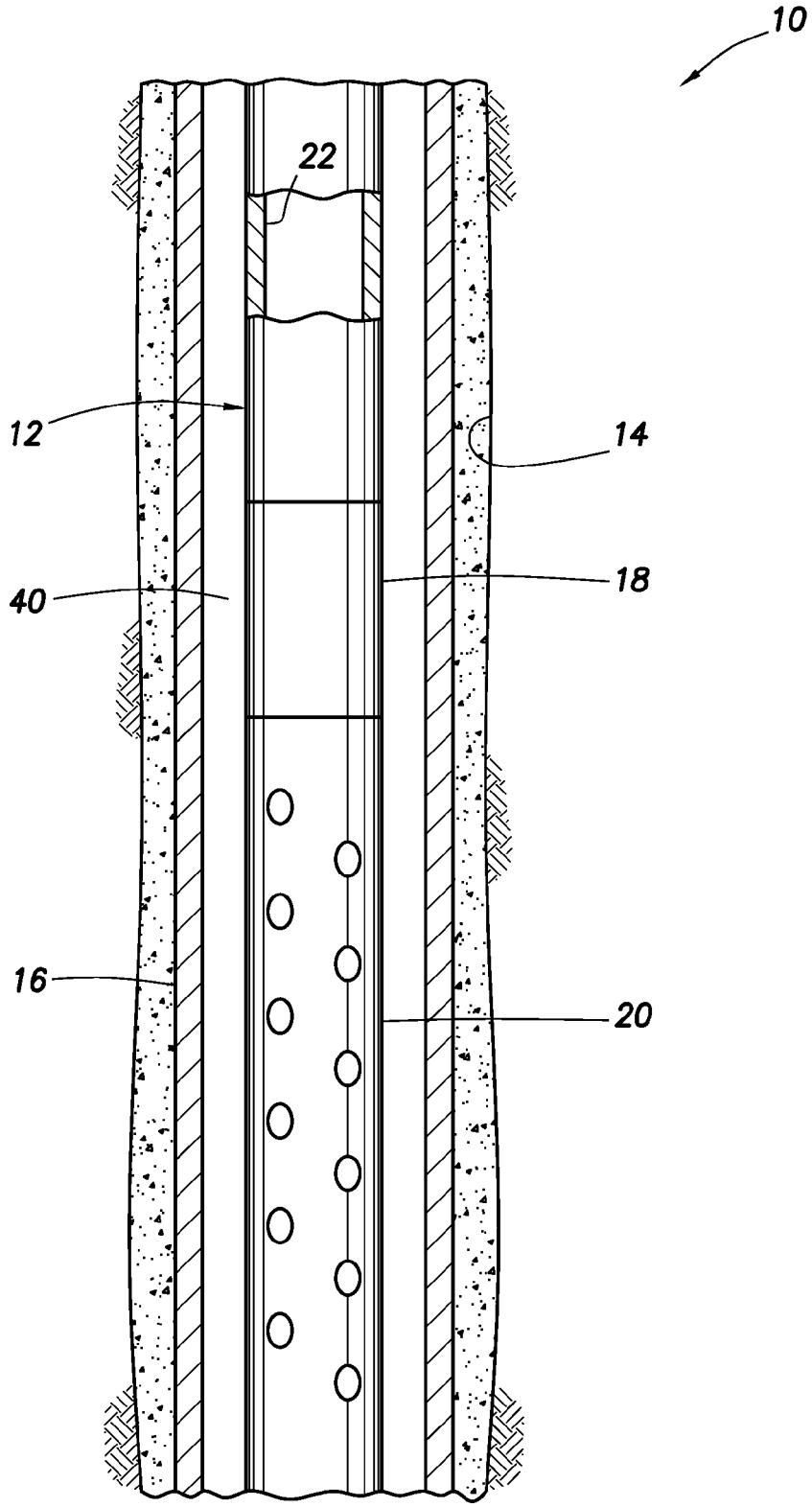
FIG. 1 is a schematic partially cross-sectional view of a well system embodying principles of the present disclosure.

Representatively illustrated in FIG. 1 is a well system 10 which embodies principles of this disclosure. In the well system 10, a tubular string 12 has been conveyed into a wellbore 14 lined with casing 16. The tubular string 12 includes a firing head 18 for detonating explosive shaped charges of a perforating gun 20, in order to form perforations through the casing 16.

In this example, multiple pressure cycles are applied to an internal flow passage 22 extending longitudinally through the tubular string 12 and in fluid communication with the firing head 18. When a predetermined number of the pressure cycles have been applied, the firing head 18 initiates detonation of the explosives in the perforating gun 20.

At this point it should be noted that the well system 10 as depicted in FIG. 1 is just one example of a wide variety of specific applications for the principles described in this disclosure. The details of the well system 10 of FIG. 1 are not strictly necessary in order to take advantage of the principles of this disclosure.

For example, the wellbore 14 could be horizontal or inclined, instead of vertical as depicted in FIG. 1, the firing head 18 could be used to initiate combustion of a propellant to set a packer, or could be used to initiate detonation of a casing or tubing cutter, etc. In other examples described below, the pressure cycles are not applied via the flow passage 22 of the tubular string 12, the principles of the disclosure are used to generate electricity, and other variations are presented. Thus, it should be clearly understood that the examples described herein are not intended to limit in any way the many varied applications for the principles of this disclosure.

Figure 2:
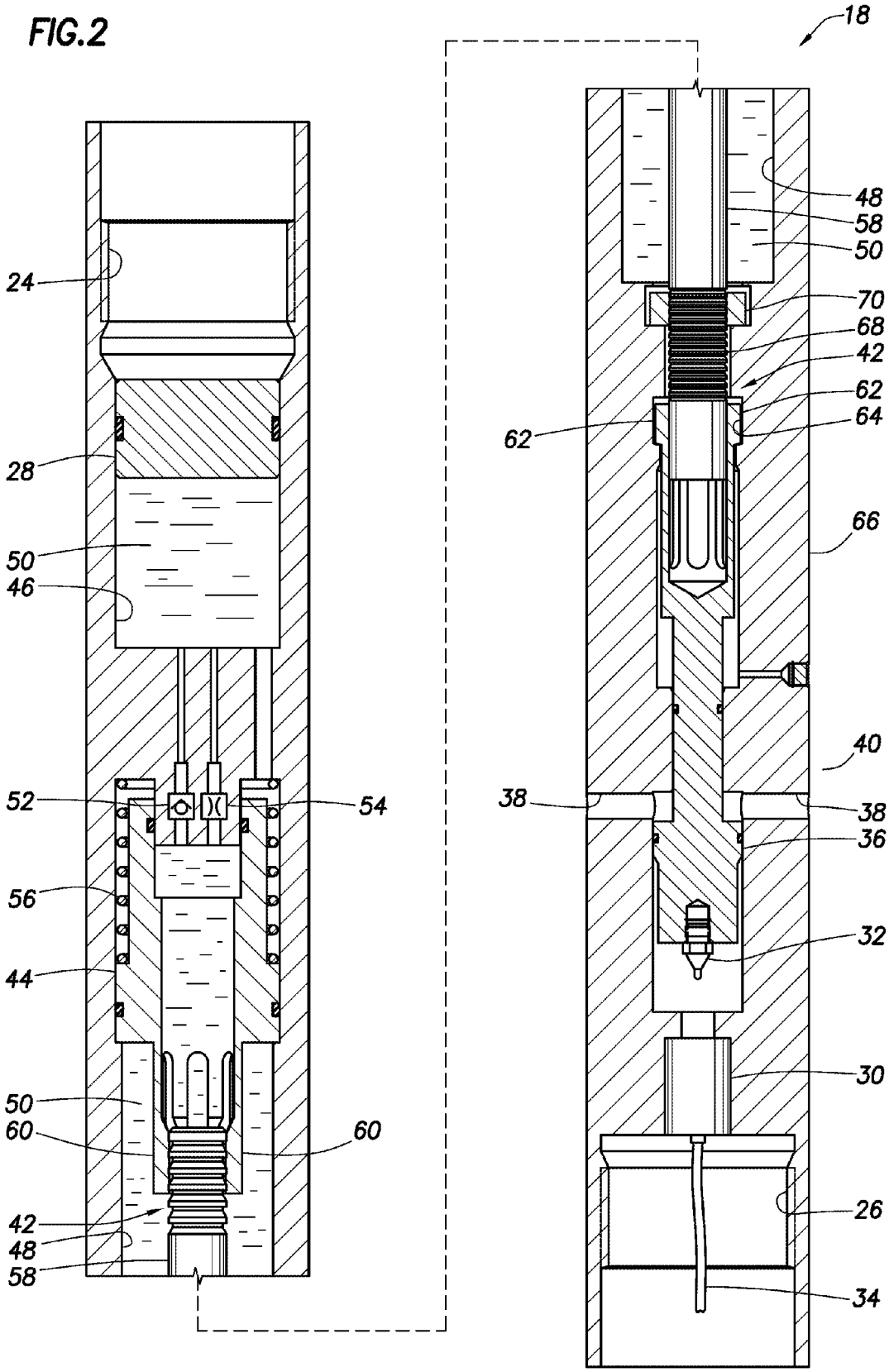
FIG. 2 is an enlarged scale schematic cross-sectional view of a firing head which may be used in the well system of FIG. 1, the firing head being shown in a run-in configuration.

Referring additionally now to FIG. 2, an enlarged scale cross-sectional view of the firing head 18 is representatively illustrated apart from the remainder of the well system 10. Of course, the firing head 18 can be used in well systems other than the well system 10, in keeping with the principles of this disclosure.

The firing head 18 includes an upper connector 24 which provides for sealed and threaded interconnection in the tubular string 12, with the flow passage 22 being in fluid communication with an upper floating piston 28 of the firing head. A lower connector 26 provides for sealed and threaded connection to the perforating gun 20.

An explosive initiator 30 is positioned below a firing pin 32. When the firing pin 32 impacts the initiator 30 with sufficient force, explosives in the initiator will ignite and initiate detonation of an explosive train including, for example, an explosive detonating cord 34 which extends through the perforating gun 20 and is used to cause detonation of the shaped charges (not shown).

Of course, many other types of explosives, combustibles, propellants, fuses, etc. can be initiated using the firing head 18. In addition, it is not necessary for an explosive train to be continuous, since pressure barriers, additional firing pins and initiators, etc. can be interposed, for example, between perforating guns or at spacers used to space apart perforating guns, etc.

The firing pin 32 is secured at a lower end of a piston 36 which is exposed to pressure external to the firing head 18 via ports 38. In the well system 10 of FIG. 1, the exterior of the firing head 18 corresponds to an annulus 40 formed radially between the tubular string 12 and the casing 16. However, in other examples, the piston 36 could be exposed to other pressure sources, such as the flow passage 22 of the tubular string 12, etc.

Pressure below the firing pin piston 36 is preferably atmospheric (or another relatively low pressure), and so the piston is biased downwardly by the much greater pressure in the annulus 40. However, a firing pin releasing device 42 prevents the firing pin 32 from being driven downward by the piston 36 until a predetermined number of pressure cycles have been applied, as described more fully below.

An actuator piston 44 separates an upper chamber 46 of the firing head 18 from a lower chamber 48. Both of the chambers 46, 48 are preferably entirely filled with a compressible fluid 50. The fluid 50 is preferably a compressible liquid (such as a silicone fluid, etc.).

A check valve 52 permits substantially unrestricted flow of the fluid 50 from the upper chamber 46 to the lower chamber 48, but prevents flow from the lower chamber to the upper chamber through the check valve. A flow restrictor 54 permits very restricted flow of the fluid 50 in both directions between the chambers 46, 48.

A biasing device 56 (such as a compression spring, etc.) biases the piston 44 toward the lower chamber 48. Thus, in steady state conditions, the piston 44 will be in its downwardly disposed position as depicted in FIG. 2, and pressure across the piston will be balanced (i.e., pressure in the chambers 46, 48 will be equal).

As described above, the floating piston 28 has its upper side exposed to the flow passage 22 of the tubular string 12. When the firing head 18 and the remainder of the tubular string 12 are installed in the well, hydrostatic pressure in the flow passage 22 and in the annulus 40 surrounding the firing head will slowly increase. The floating piston 28 will transmit this increased hydrostatic pressure to the upper chamber 46, and to the lower chamber 48 via the check valve 52 and flow restrictor 54, and so pressure across the piston 44 will remain balanced.

When the perforating gun 20 has been appropriately positioned in the casing 16 (e.g., to form perforations through the casing at a particular depth), a number of pressure increases and decreases will be applied to the flow passage 22 (e.g., using a pump or other pressure source at the surface) to cause the piston 44 to reciprocably displace up and down, and thereby actuate the firing pin releasing device 42 to release the firing pin 32 and detonate the initiator 30 and explosives of the perforating gun 20.

A pressure increase applied to the flow passage 22 will be transmitted equally to the chambers 46, 48 as described above. However, when pressure in the flow passage 22 is decreased, pressure in the upper chamber 46 will decrease faster than pressure in the lower chamber 48. This is due to the fact that the flow restrictor 54 permits only very restricted flow of the fluid 50 from the lower chamber 48 to the upper chamber 46 and, therefore, pressure in the lower chamber is relieved slower than pressure in the upper chamber.

Figure 3:
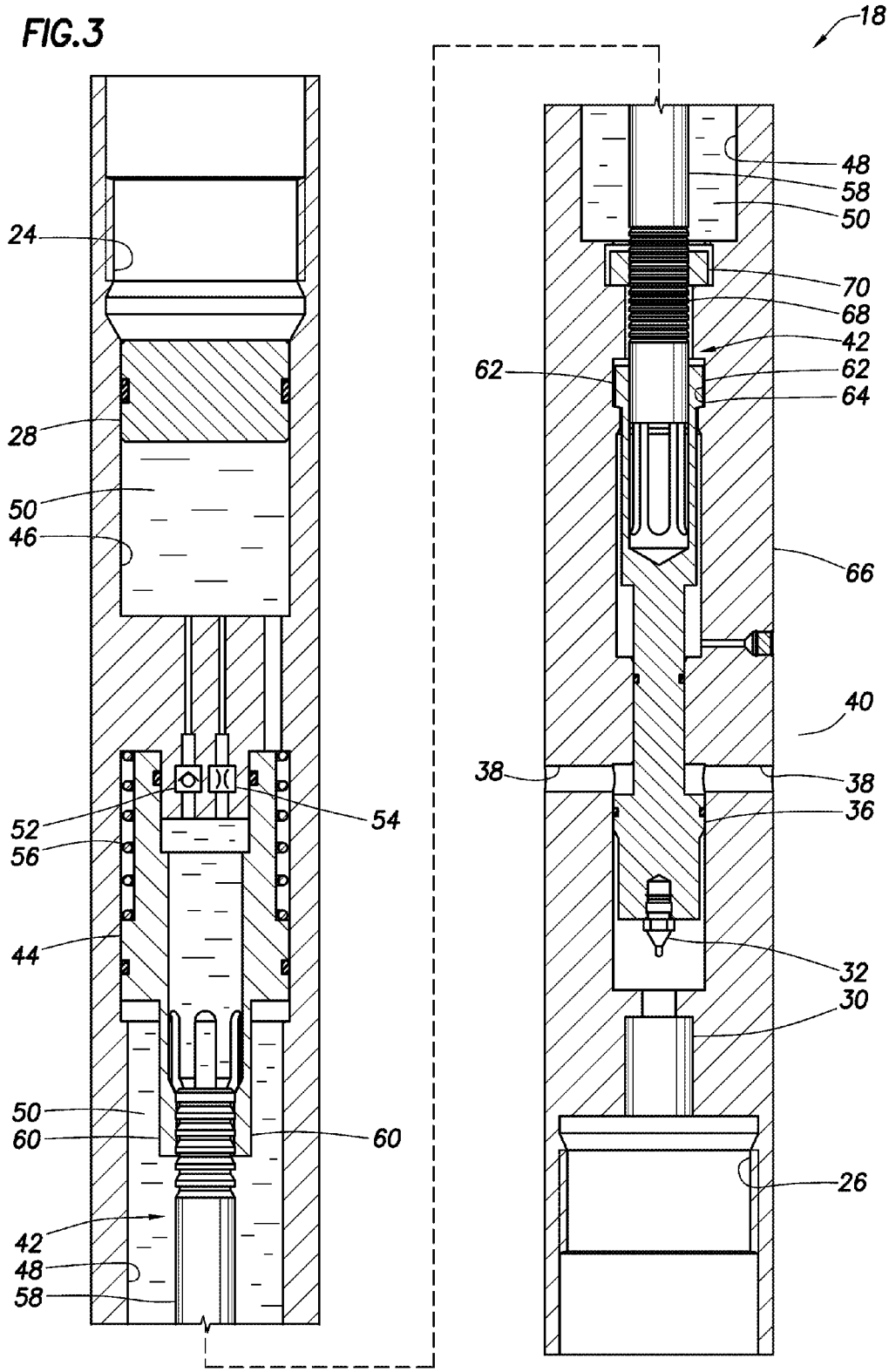
FIG. 3 is a schematic cross-sectional view of the firing head in a configuration in which pressure has been applied and then relieved from the firing head.

Referring additionally to FIG. 3, the firing head 18 is representatively illustrated after pressure in the flow passage 22 has been decreased. Note that the piston 44 has displaced upward somewhat due to the increased pressure in the lower chamber 48 relative to pressure in the upper chamber 46.

Eventually, the piston 44 will return to its downward position as depicted in FIG. 2, since the biasing device 56 will urge the piston downward and the flow restrictor 54 will permit pressures in the chambers 46, 48 to slowly equalize. The piston 44 can then be displaced upward again by repeating the cycle of increasing and decreasing pressure in the flow passage 22.

Thus, the piston 44 can be conveniently reciprocated in the firing head 18 by simply increasing and decreasing pressure in the flow passage 22 of the tubular string 12. This reciprocating displacement of the piston 44 is used to incrementally displace a release member 58 of the releasing device 42 so that, after a certain number of the pressure increases and decreases, the firing pin 32 is released to impact the initiator 30.

Figure 4:
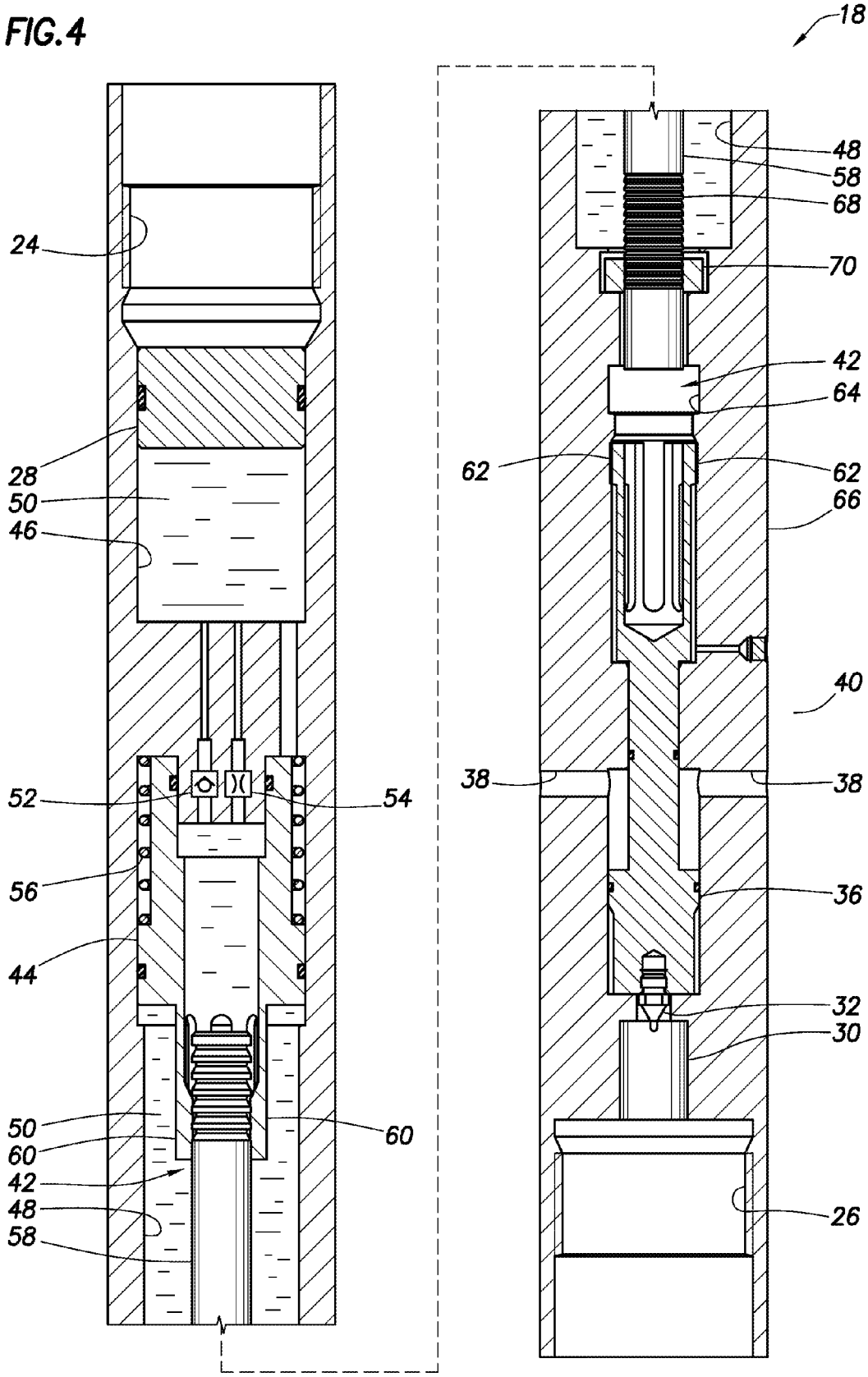
FIG. 4 is a schematic cross-sectional view of the firing head in a configuration in which a firing pin has been released to detonate explosives in a perforating gun.

The release member 58 is in the form of an elongated rod as depicted in FIGS. 2-4, but other forms (e.g., sleeve, etc.)

could be used, if desired. An upper end of the release member 58 is received in resilient gripping fingers 60 which encircle the member and extend downwardly from the piston 44. The upper end of the member 58 is circumferentially ridged so that the fingers 60 grip the member and prevent the member from being withdrawn from the fingers, but the member can be relatively easily pushed into the fingers.

A lower end of the member 58 is received within resilient collets 62 formed on an upper end of the firing pin piston 36. Radially outwardly enlarged portions of the collets 62 are received in an annular recess 64 formed in a housing assembly 66 of the firing head 18. The lower end of the member 58 retains the collets 62 in engagement with the recess 64, thereby preventing the piston 36 from displacing downwardly, and preventing the firing pin 32 from impacting the initiator 30.

Another ridged portion 68 of the member 58 is received in an annular gripping member 70 in the housing assembly 66. Engagement between the ridged portion 68 and the gripping member 70 prevents downward displacement of the release member 58, but permits upward displacement of the release member, relative to the housing assembly 66.

Thus, when the piston 44 displaces upward as depicted in FIG. 3, the release member 58 also displaces upward (due to the engagement between the fingers 60 and the ridged upper end of the member 58), but when the piston displaces downward, the release member does not also displace downward (due to the engagement between the gripping member 70 and the ridged portion 68 of the release member 58). However, the release member 58 is received further into the fingers 60 when the piston 44 displaces downward.

In this manner, the release member 58 is incrementally advanced in an upward direction as the piston 44 is reciprocably displaced upward and downward by corresponding pressure decreases and increases in the flow passage 22 which alternately unbalance and balance pressures across the piston. Eventually, the release member 58 will displace upwardly a sufficient distance that it will no longer outwardly support the collets 62, and the firing pin piston 36 will be released to drive the firing pin 32 downward to impact the initiator 30.

Referring additionally now to FIG. 4, the firing head 18 is representatively illustrated after the release member 58 no longer supports the collets 62, and the firing pin piston 36 has been released to displace downward so that the firing pin 32 impacts the initiator 30. It will be appreciated that this desirable result has been achieved conveniently and reliably by merely increasing and decreasing pressure in the flow passage 22 of the tubular string 12.

As described below, the pressure increases and decreases can be applied in other ways, in keeping with the principles of this disclosure. In addition, note that the number of pressure cycles needed to release the firing pin piston 36 can be conveniently adjusted by adjusting the length of the release member 58 received within the collets 62. Alternatively, or in addition, the stroke length of the piston 44 can be changed to thereby change the number of pressure cycles needed to release the firing pin piston 36.

In the configuration of FIGS. 1-4, the firing head 18 closes off the lower end of the flow passage 22 in the tubular string 12, i.e., the flow passage does not extend longitudinally through the firing head. In other embodiments, the flow passage 22 could extend through the firing head 18, if desired.

Figure 5:
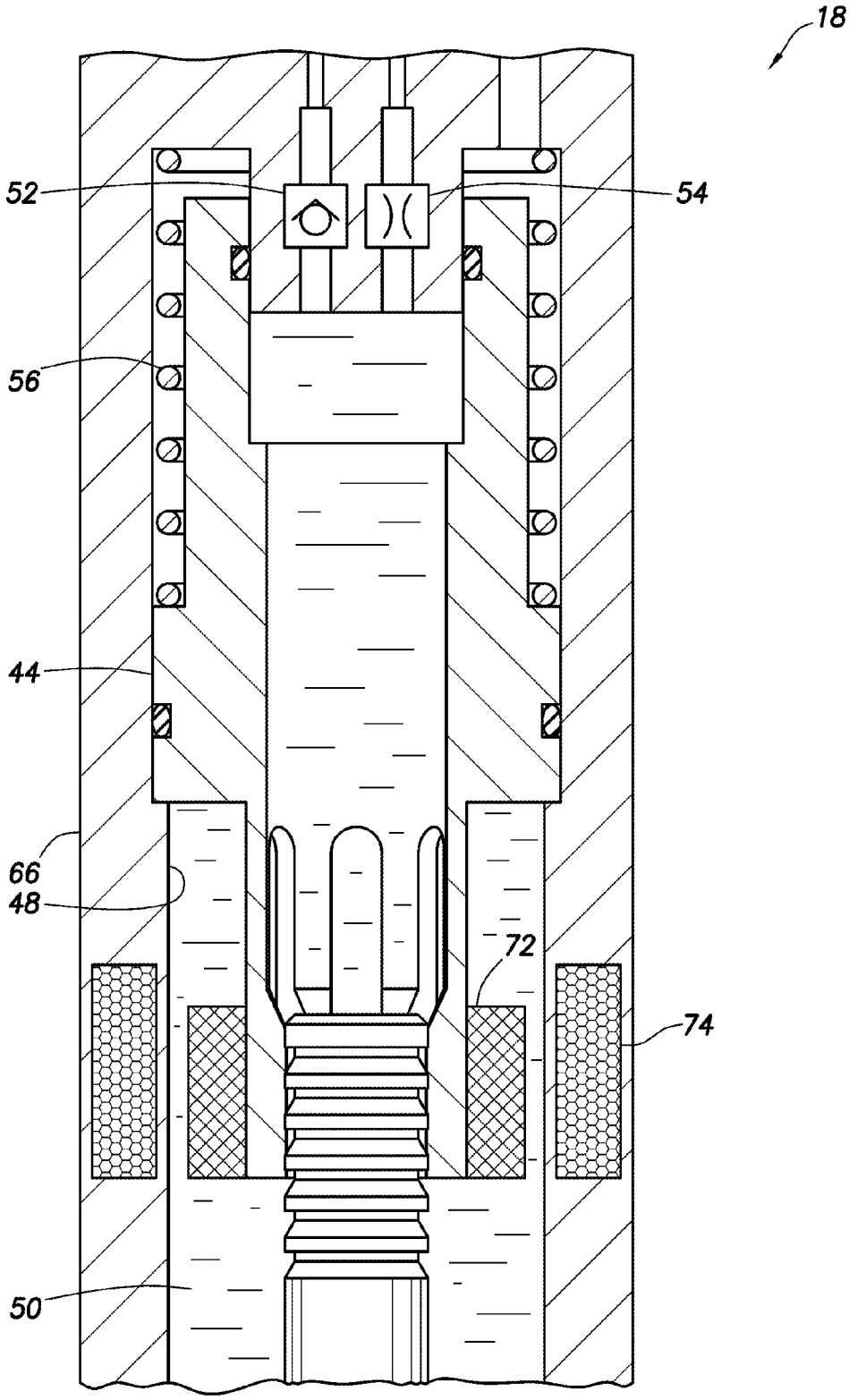
FIG. 5 is a further enlarged scale schematic cross-sectional view of a portion of the firing head, showing an electrical generator which may be incorporated therein.

Referring additionally now to FIG. 5, a further enlarged scale view of a portion of the firing head 18 is representatively illustrated. In this configuration of the firing head 18, reciprocal displacement of the piston 44 is used to generate electricity, for example, for use in detonating an electrical detonator.

Of course, other uses for the generated electricity can be made, for example, to provide power for operation of other well tools, sensors, communication systems, etc. If, however, the electricity is to be used to detonate an electrical detonator or otherwise electrically ignite a combustible material, then the releasing device 42 described above may not be used in the firing head 18.

As depicted in FIG. 5, an annular shaped magnet 72 is secured to a lower end of the piston 44 and an annular shaped coil 74 is received in a wall of the housing assembly 66. As the piston 44 reciprocates upward and downward, the magnet 72 displaces upward and downward through the coil 74, thereby generating electricity.

Figure 6:
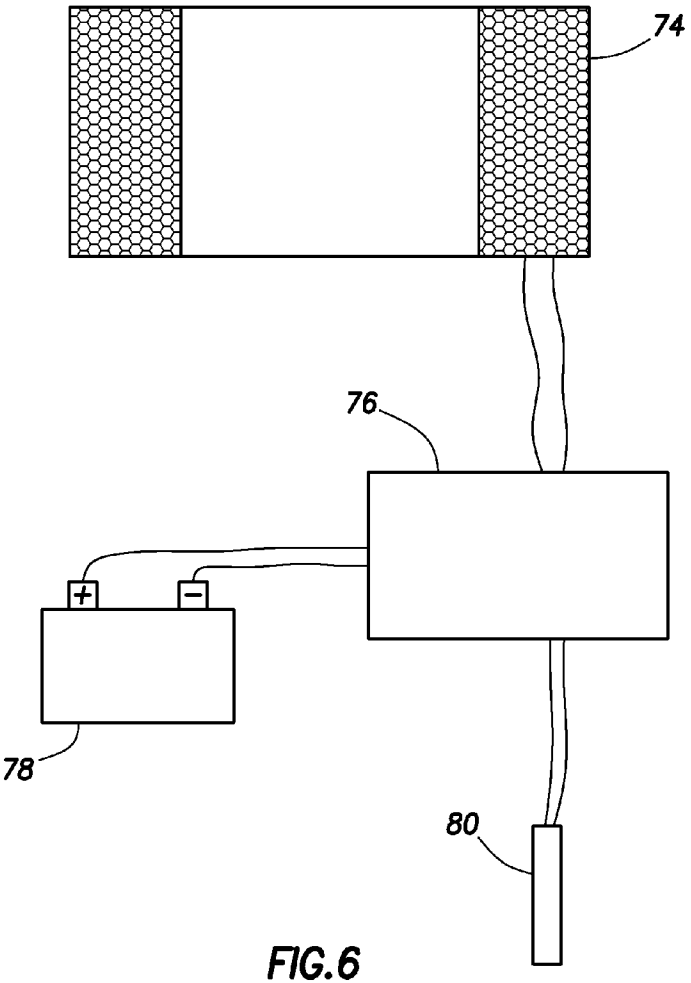
FIG. 6 is an electrical schematic diagram of the electrical generator as used to detonate explosives in the perforating gun.

Referring additionally now to FIG. 6, a schematic electrical diagram is representatively illustrated. Note that the coil 74 is connected to an electronic circuit 76. The electronic circuit 76 can utilize the electrical power generated by the magnet 72 and coil 74 to charge a battery or other electrical storage device 78.

Alternatively, or in addition, the electronic circuit 76 can deliver the electrical power to an electrical detonator 80. The electrical detonator 80 can take the place of the initiator 30 in the firing head 18, in which case the firing pin 32, piston 36 and releasing device 42 may not be used.

Preferably, the electronic circuit 76 delivers the electrical power to the detonator 80 in response to a predetermined number of reciprocal displacements of the actuator piston 44, which the circuit can detect as a corresponding number of electrical power generations by the coil 74. Alternatively, the electronic circuit 76 could supply electrical power to the detonator 80 in response to other stimulus (such as a particular timed pattern of pressure increases and decreases, a certain pressure level or levels as sensed by a pressure sensor, etc.).

Figure 7:
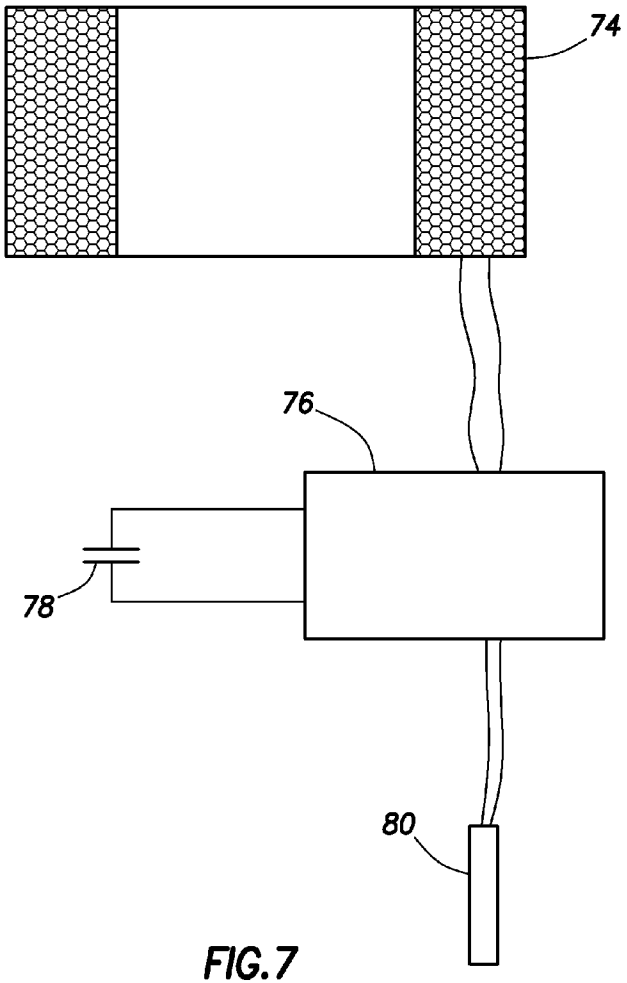
FIG. 7 is another configuration of the electrical schematic diagram.

Referring additionally now to FIG. 7, the electrical schematic diagram is representatively illustrated in another configuration in which the electrical storage device 78 comprises a capacitor, instead of a battery as depicted in FIG. 6. This demonstrates that various configurations of the electrical circuit may be utilized, in keeping with the principles of this disclosure.

Figure 8:
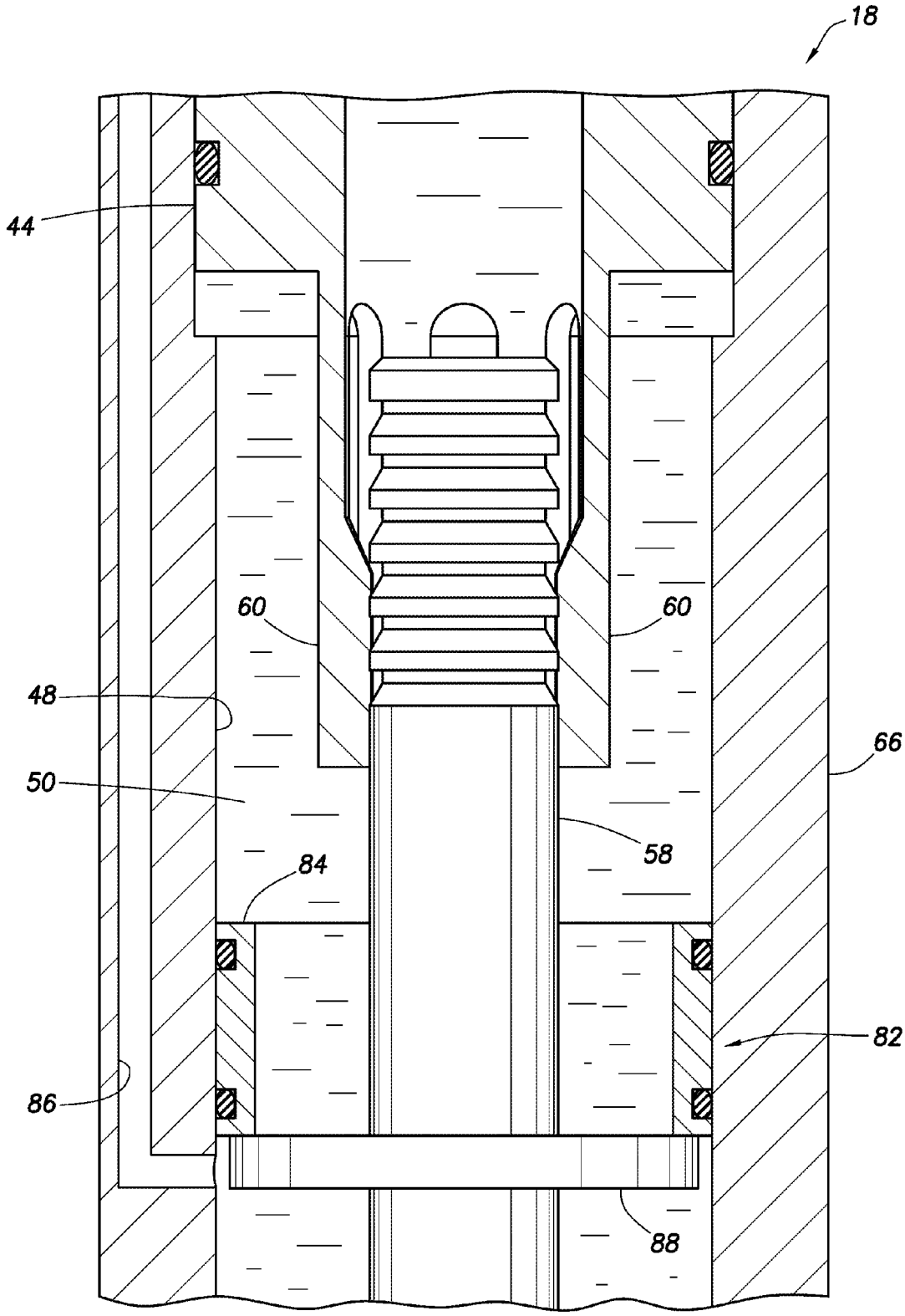
FIG. 8 is a schematic cross-sectional view of a portion of the firing head, showing a valve device which may be incorporated therein.

Referring additionally now to FIG. 8, another configuration of the firing head 18 is representatively illustrated. In this configuration, the firing head 18 includes a valve device 82 which selectively prevents and permits fluid communication between the upper and lower chambers 46, 48.

As depicted in FIG. 8, the valve device 82 includes a sleeve 84 which initially closes off a passage 86 extending between the upper and lower chambers 46, 48. However, when the release member 58 has been displaced upwardly a sufficient distance in response to a predetermined number of reciprocal displacements of the piston 44 as described above, a radially enlarged collar 88 on the release member will contact and upwardly displace the sleeve 84, thereby opening the passage 86 to permit fluid communication between the chambers 46, 48.

Preferably, the valve device 82 is opened to permit direct two-way and substantially unrestricted fluid communication between the upper and lower chambers 46, 48 after the initiator 30 has been impacted by the firing pin 32 or the electrical detonator 80 has been detonated. In this manner, further reciprocal displacements of the piston 44 can be avoided (since no further pressure unbalancing of the piston 44 will be produced) if the firing head 18 is to be retrieved to the surface, for example, in the event of a malfunction.

Thus, the predetermined number of pressure cycles can be applied to the firing head 18 to cause ignition of the explosives of the perforating gun 20 but, if there is a malfunction (such as a failure of the firing pin 32 to impact the initiator 30 with sufficient force to initiate detonation, a short circuit or open circuit preventing detonation of the electrical detonator 80, etc.), additional pressure cycles can be applied to open the valve device 82. Once the valve device 82 is opened, the piston 44 will be unaffected by any further pressure cycles, and the firing head 18 can be safely retrieved to the surface.

In other embodiments, the passage 86 may not provide fluid communication with the upper chamber 46, but instead could provide fluid communication with other chambers, etc. For example, opening of the valve device 82 could be used to pressure balance the firing pin piston 36, to actuate another well tool, etc. The passage 86 could be used to actuate a pilot-operated shuttle valve to disarm the firing head 18 by opening the area below the firing pin piston 36 to pressure in the annulus 40 or flow passage 22, etc.

Figure 11:
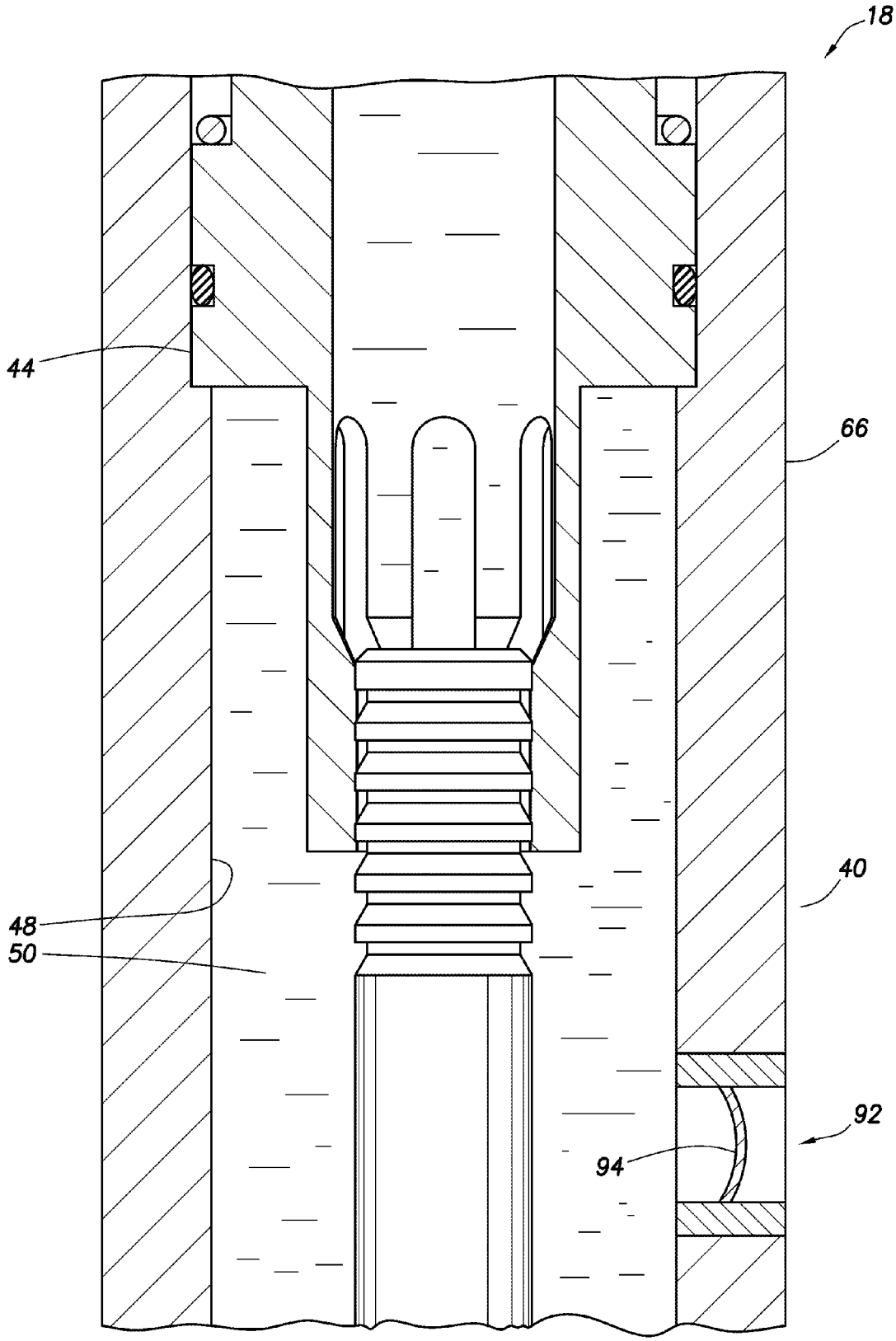
FIG. 11 is an enlarged scale schematic cross-sectional view of a portion of the firing head, showing another valve device which may be incorporated therein.

Another manner of rendering the firing head 18 safe for retrieval from the well is representatively illustrated in FIG. 11. In this configuration of the firing head 18, another valve device 92 is used to selectively prevent and permit fluid communication between the lower chamber 48 and the annulus 40.

As depicted in FIG. 11, the valve device 92 is in the form of a rupture disc 94 which opens when a predetermined pressure differential is applied from the lower chamber 48 to the annulus 40. Other types of valve devices, such as a displaceable plug, shuttle valve, etc., may be used if desired.

By providing fluid communication between the lower chamber 48 and the annulus 40, the lower chamber will no longer respond to pressure fluctuations in the tubular string 12. In addition, as the pressure in the annulus 40 surrounding the firing head 18 gradually decreases during retrieval of the firing head, the piston 44 will be maintained in its lowermost position, thereby preventing accidental release of the firing pin piston 36.

Figure 9:
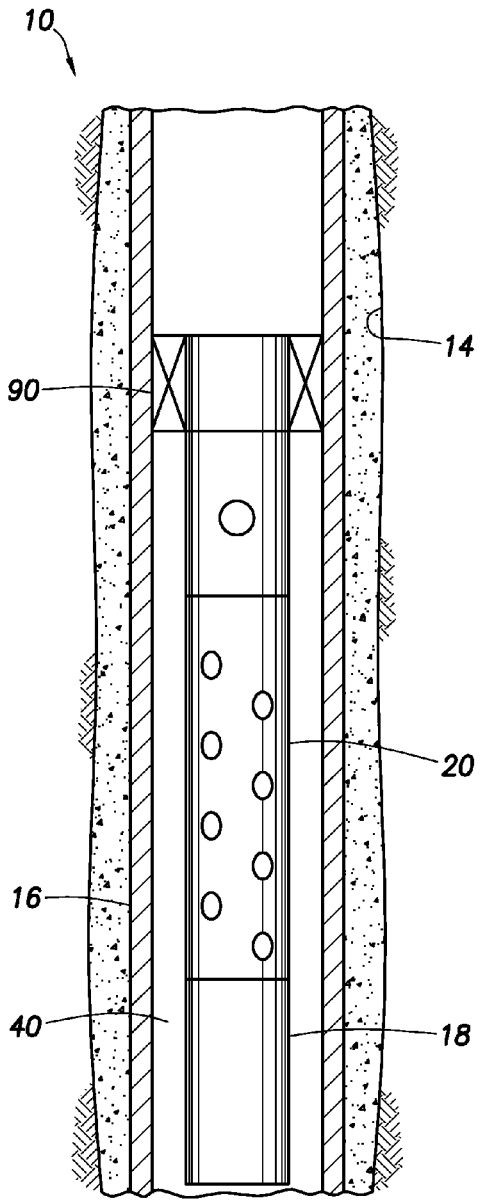
FIG. 9 is a schematic partially cross-sectional view of another configuration of the well system.

Referring additionally now to FIG. 9, another configuration of the well system 10 is representatively illustrated. In this configuration, pressure cycles are not applied to the firing head 18 via the flow passage 22 of the tubular string 12. Instead, the pressure cycles are applied via the casing 16, with the perforating gun 20 and firing head 18 being suspended in the casing using a hanger or other anchoring device 90.

Figure 10:
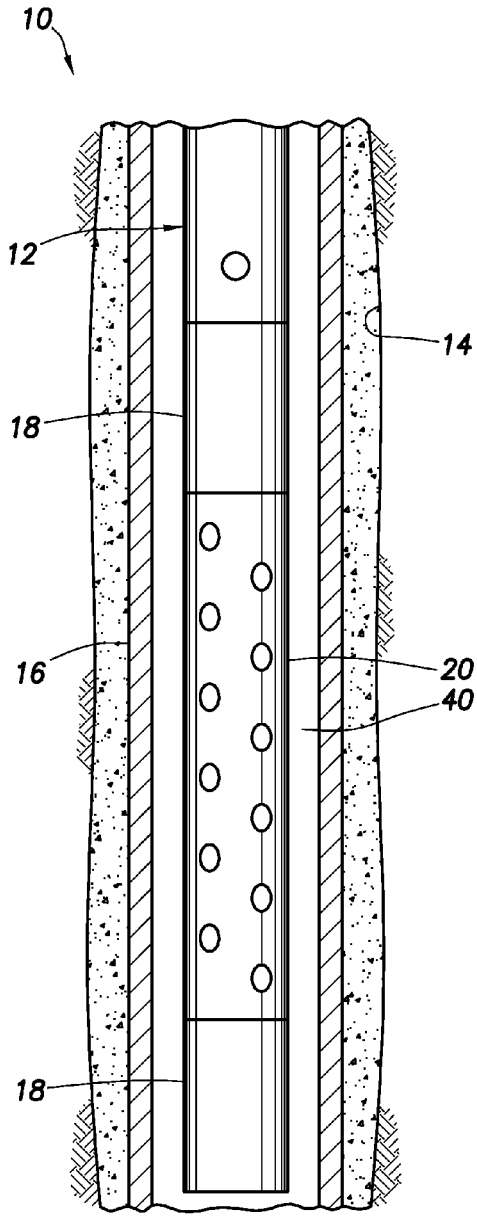
FIG. 10 is a schematic partially cross-sectional view of yet another configuration of the well system.

In FIG. 10, another configuration of the well system 10 is representatively illustrated in which the tubular string 12 is used to deliver the pressure cycles to two firing heads 18 connected above and below the perforating gun 20. The multiple firing heads 18 are redundant to ensure that the perforating gun 20 is detonated, even if one of the firing heads should malfunction. The firing heads 18 could be configured to respond to different levels of pressure, if desired.

Figure 12:
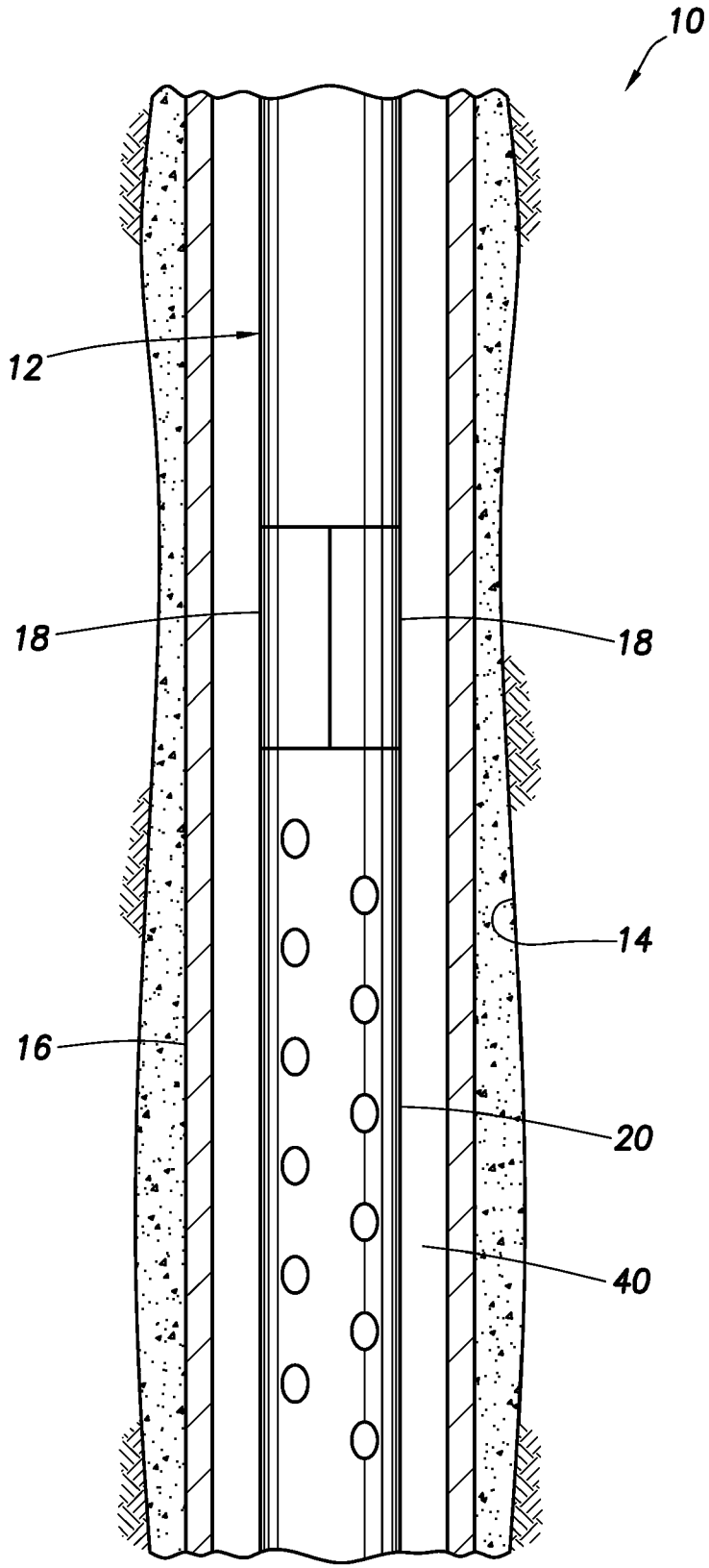
FIG. 12 is a schematic partially cross-sectional view of a further configuration of the well system.

In FIG. 12, yet another configuration of the well system 10 is representatively illustrated in which multiple redundant firing heads 18 are connected at an upper end of the perforating gun 20. Again, the multiple firing heads 18 are redundant to ensure that the perforating gun 20 is detonated, even if one of the firing heads should malfunction, and the firing heads 18 could be configured to respond to different levels of pressure, if desired.

Note that, in the well system 10 configurations of FIGS. 1 and 12, the pressure cycles are applied to the firing head(s) 18 from the flow passage 22 of the tubular string 12, and in the configurations of FIGS. 9 and 10 the pressure cycles are applied to the firing head(s) from the annulus 40 external to the firing head(s). This demonstrates that the pressure cycles may be applied to the firing head 18 by any transmitting means and by any type of pressure source. Other pressure transmitting means and sources could include control lines, downhole pumps, etc.

It may now be fully appreciated that the above disclosure provides significant advancements to at least the arts of firing head construction and generating electricity downhole. The firing head 18 includes the chambers 46, 48 which do not need to be highly pressurized at the surface, and which do not need thick walls to withstand large pressure differentials at the surface or downhole. No shear pins are needed to set an actuation pressure of the firing head 18 (although shear pins could be utilized in the firing head in keeping with the principles of this disclosure).

The above disclosure describes a method of actuating a firing head 18 in a subterranean well, with the method including the steps of: reciprocably displacing an actuator piston 44 of the firing head 18 in the well, and igniting a combustible material (such as in initiator 30 or electrical detonator 80) in response to the piston displacing step. The displacing step includes the piston 44 being alternately pressure balanced and unbalanced.

The igniting step can include detonating explosives (such as detonating cord 34, shaped charges, etc.) of a perforating gun 20. The method may include the step of incrementally advancing a firing pin releasing device 42 in response to reciprocations of the piston 44 in the piston displacing step.

The piston 44 may separate two chambers 46, 48, and the piston displacing step may include applying pressure substantially equally to the chambers, and then relieving the applied pressure from one chamber 46 at a greater rate than relieving the applied pressure from the other chamber 48, thereby pressure unbalancing the piston 44.

The method may include the step of providing substantially unrestricted two-way fluid communication between the chambers 46, 48 in response to a predetermined number of reciprocations of the piston 44. The method may include the step of opening a valve device 92 in response to a predetermined pressure being applied to the second chamber 48. The method may include the step of pressure balancing a firing pin piston 36 in response to a predetermined number of reciprocations of the actuator piston 44.

Also described above is a method of generating electricity in a subterranean well. The method includes the steps of: reciprocably displacing a piston 44 in the well, and generating electricity in response to the piston displacing step. The displacing step includes the piston 44 being alternately pressure balanced and unbalanced.

The piston 44 may separate two chambers 46, 48, and the piston displacing step may include applying pressure substantially equally to the chambers, and then relieving the applied pressure from one chamber 46 at a greater rate than relieving the applied pressure from the other chamber 48, thereby pressure unbalancing the piston 44.

The piston displacing step may include reciprocably displacing a magnet 72 relative to a coil 74.

The electricity generating step may include charging an electrical storage device 78.

The method may include the step of using electricity generated in the generating electricity step to detonate an explosive device (such as the detonator 80, detonating cord 34, shaped charges, etc.). The explosive device may be detonated in response to a predetermined number of reciprocations of the piston 44 in the piston displacing step.

A firing head 18 for detonating explosives in a subterranean well is also described in the above disclosure. The firing head 18 includes an actuator piston 44 separating at least two chambers 46, 48, a check valve 52 which permits flow from the first chamber 46 to the second chamber 48, but prevents flow from the second 48 chamber to the first chamber 46, a flow restrictor 54 which restricts flow between the chambers 46, 48; a biasing device 56 which biases the piston 44 toward the second chamber 48; and a firing pin releasing device 42 which releases a firing pin 32 in response to displacement of the piston 44.

The firing head 18 may also include a firing pin piston 36, whereby a pressure differential across the firing pin piston 36 displaces the firing pin 32 when the firing pin releasing device 42 releases in response to displacement of the actuator piston 44.

The second chamber 48 may contain a compressible liquid 50. The compressible liquid 50 may substantially entirely fill the second chamber 48.

The actuator piston 44 may incrementally displace a release member 58 of the releasing device 42 in response to each of multiple reciprocating displacements of the actuator piston 44.

The firing head 18 may also include a valve device 82 which permits substantially unrestricted fluid communication between the chambers 46, 48 in response to a predetermined number of displacements of the actuator piston 44.

The firing head 18 may include a valve device 92 which opens in response to a predetermined pressure being applied to the second chamber 48.

It should be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A method of actuating a firing head in a subterranean well, the method comprising the steps of:

increasing a pressure applied to an actuator piston of the firing head, wherein the actuator piston is not displaced during the pressure increasing step;

then decreasing the pressure, thereby causing reciprocation of the actuator piston of the firing head; and igniting a combustible material in response to a first predetermined number of reciprocations of the actuator piston.

2. The method of claim 1, wherein the igniting step further comprises detonating explosives of a perforating gun.

3. The method of claim 1, further comprising the step of incrementally advancing a firing pin releasing device in response to the reciprocations of the actuator piston.

4. The method of claim 1, wherein the actuator piston separates first and second chambers, and wherein the pressure increasing and decreasing steps further comprise applying pressure substantially equally to the first and second chambers, and then relieving the applied pressure from the first chamber at a greater rate than relieving the applied pressure from the second chamber, thereby causing reciprocation of the actuator piston.

5. The method of claim 4, further comprising the step of providing substantially unrestricted two-way fluid communication between the first and second chambers in response to a second predetermined number of reciprocations of the actuator piston.

6. The method of claim 4, further comprising the step of opening a valve device in response to a predetermined pressure being applied to the second chamber.

7. The method of claim 4, further comprising the step of releasing a firing pin piston in response to the first predetermined number of reciprocations of the actuator piston.

8. A method of generating electricity in a subterranean well, the method comprising the steps of:

reciprocably displacing a piston in the well, the displacing step including the piston being alternately pressure balanced and unbalanced; and generating electricity in response to the piston displacing step, wherein the piston separates first and second chambers, and wherein the piston displacing step further comprises applying pressure substantially equally to the first and second chambers, and then relieving the applied pressure from the first chamber at a greater rate than relieving the applied pressure from the second chamber, thereby pressure unbalancing the piston.

9. The method of claim 8, wherein the piston displacing step further comprises reciprocably displacing a magnet relative to a coil.

10. The method of claim 8, wherein the electricity generating step further comprises charging an electrical storage device.

11. The method of claim 8, further comprising the step of using electricity generated in the generating electricity step to detonate an explosive device.

12. The method of claim 11, wherein the explosive device is detonated in response to a predetermined number of reciprocations of the piston in the piston displacing step.

* * * * *